United States Patent [19]

Skerchock et al.

[11] Patent Number: 4,817,685

[45] Date of Patent: Apr. 4, 1989

[54] APPARATUS AND METHOD FOR SIMULTANEOUSLY FILLING MULTIPLE MUNITIONS ITEMS WITH EXPLOSIVE

[75] Inventors: Peter Skerchock, Little Falls; Lawrence Honablew, Morristown; Antonio Caldrelli, Morris County, all of N.J.; LeRoy D. Cooper, Riverton, Kans.

[73] Assignee: The United States of America as represented by the Secretary of the Army, Washington, D.C.

[21] Appl. No.: 34,529

[22] Filed: Apr. 6, 1987

[51] Int. Cl.[4] ..... B65B 3/12; C06B 21/00

[52] U.S. Cl. ..... 141/11; 141/82; 141/258; 141/240; 141/244; 264/3.1; 86/20.12

[58] Field of Search ..... 141/69, 82, 1, 11, 9, 141/129, 177, 224, 237, 238, 240, 242, 245, 251, 253, 255, 258, 259, 261, 275, 277, 286, 310, 369, 370, 244, 31, 115, 102; 264/3.1, 3.3; 86/20.12, 20.1

[56] References Cited

U.S. PATENT DOCUMENTS

| | | | |
|---|---|---|---|
| 3,004,462 | 10/1961 | Cook et al. | 86/20.12 X |
| 3,107,574 | 10/1963 | Mebrane | 86/20.12 |
| 3,640,585 | 2/1972 | Hamilton et al. | 86/20.1 X |
| 3,870,089 | 3/1975 | Laub, III | 141/367 X |
| 4,300,603 | 11/1981 | Laub, III | 141/258 |
| 4,336,209 | 6/1982 | Gylden et al. | 264/3.1 |
| 4,409,155 | 10/1983 | Bonnycastle et al. | 364/3.1 |
| 4,437,498 | 3/1984 | Pankratz et al. | 141/258 X |
| 4,688,609 | 8/1987 | Diaz | 141/82 |

FOREIGN PATENT DOCUMENTS

| | | | |
|---|---|---|---|
| 915245 | 1/1963 | United Kingdom | 86/20.12 |

*Primary Examiner*—Ernest G. Cusick

*Attorney, Agent, or Firm*—Robert P. Gibson; Edward Goldberg; Edward F. Costigan

[57] ABSTRACT

Apparatus and method are provided for stirring an explosive materials mixture maintained in a molten state to ensure homogeneity of its composition and for simultaneous transfer of predetermined quantities thereof, by effecting the transfers primarily in a horizontal direction, via a plurality of positive displacement piston-cylinder mechanisms and a corresponding plurality of pneumatically controlled spool valves for injection into a plurality of munitions items through detachable intermediate distribution elements that also serve as temporary risers. An explosive material mixture, containing a molten component and particulate matter which would otherwise precipitate out, is thus delivered in a homogeneous form into each of a plurality of individual munitions items of similar shape and size in amounts controlled to ensure safe and adequate filling of the munitions items and the provision of only small surpluses of explosive material to accommodate shrinkage during cooling of the filled munitions items, and limiting the amount of riser scrap that must be collected and disposed subsequent to each such filling.

12 Claims, 4 Drawing Sheets

Fig. 2
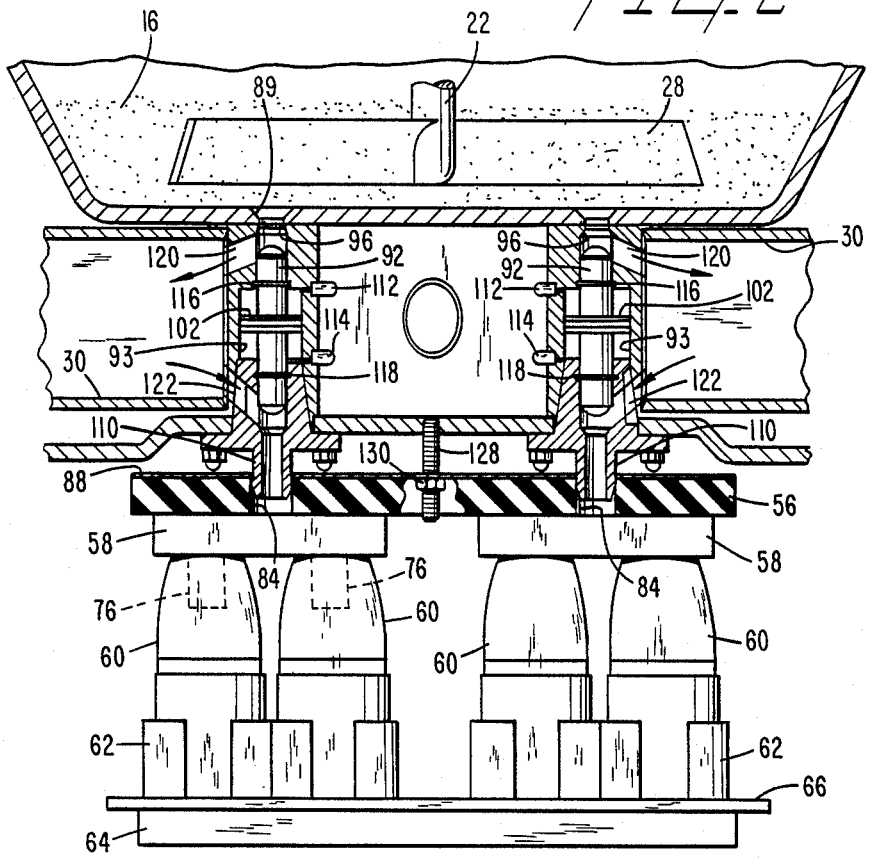
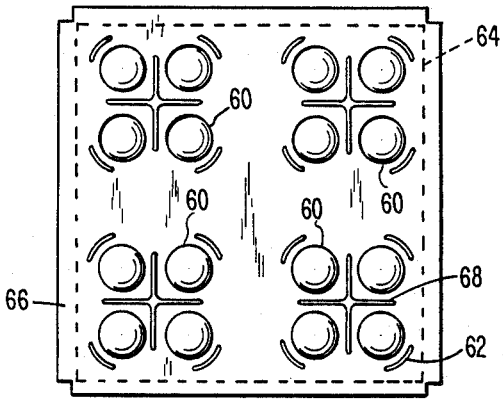
Fig. 4A
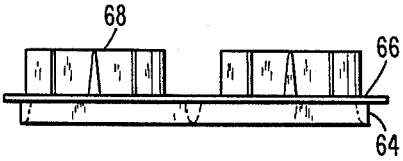
Fig. 4B

APPARATUS AND METHOD FOR SIMULTANEOUSLY FILLING MULTIPLE MUNITIONS ITEMS WITH EXPLOSIVE

TECHNICAL FIELD

This invention relates generally to an apparatus and a method for rapidly filling large numbers of similar munitions items with explosive material and, more particularly, to apparatus and methods for forcibly and simultaneously injecting into each of a plurality of similar empty munitions items a controlled quantity of an explosive mixture of a meltable component and a particulate component.

BACKGROUND OF THE INVENTION

A large variety of munitions items, e.g., combined effects munitions (CEMs), are formed with a cavity that is filled with a specific amount of explosive material during manufacture. Until recently, one conventional technique was to melt a small amount of explosive material such as 70/30 Cyclotol or 60/40 Comp B explosive in a "kettle" and pour it into individual empty munitions items, with provision of a riser for a certain amount of the material to rise therein when the item is filled. As the poured explosive material cools within the munitions item, it experiences some shrinkage and draws in some of the still molten material from the riser. Eventually the riser material is knocked off and the excess explosive material therein is collected for reuse or disposal. This known technique is wasteful, slow and somewhat dangerous. The amount of riser material that is scrapped with each munitions item filled often is a high percentage of the material initially melted. Naturally, this represents an energy waste and carries with it an inherent danger of accidents as the scrap has to be collected manually and recycled or reprocessed. Also, because the method requires much personal handling by relatively skilled operators it is both slow and expensive. This is especially true when large numbers of similar munitions items are to be filled.

Initial experiments aimed at developing apparatus and methods for injection loading of molten explosive into individual munitions items employed a vertical downward dispensation of a controlled volume of molten explosive into the empty item held upright, somewhat similar to the action of a vertically held hypodermic syringe used by a doctor to inject a fluid into a body part. Particulate HMX in the molten explosive material mixture had a tendency to settle out in front of the discharge valve in this apparatus and caused intermittent clogging of the valve. Thus, while this solution is capable of reducing riser scrap to approximately 10% (compared to as much as 300% by older methods) with explosives such as 70/30 Cyclotol or 60/40 Comp B, it is unsuitable for use with a viscous explosive like Octol which is normally mixed with the particulate component HMX. The problem is aggravated when large numbers of similar munitions items are to be filled.

Further research and development led to the development of the apparatus and method of the present invention, which provides a user the facility to inject a controlled amount of virtually any meltable explosive, including mixtures containing particulates, simultaneously into pluralities of munitions items consistently, quickly, with the production of only a minimal amount of riser scrap, and to a higher loading density than the acceptable minimum.

DISCLOSURE OF THE INVENTION

It is an object of this invention to provide a controlled amount of a meltable explosive material to simultaneously fill each of a plurality of similar munitions items.

It is a further object of this invention to provide apparatus for the simultaneous filling of each of a plurality of similar munitions items with a controlled amount of a meltable explosive containing a particulate component.

It is an even further object of this invention to provide apparatus for the simultaneous filling of each of a plurality of similar munitions items to a high loading density with consistently controlled amounts of a melted explosive mixture containing a particulate component with only a very small amount of explosive material turning into riser scrap.

It is a related object of this invention to provide a method for simultaneously filling each of a plurality of similar munitions items with a controlled amount of a meltable explosive material.

It is another related object of this invention to provide a method for the simultaneous filling of each of a plurality of similar munitions items to a high loading density with controlled amounts of a meltable explosive material containing a particulate component.

It is yet another related object of this invention to provide a method for simultaneously and consistently filling each of a plurality of similar munitions items to a high loading density with a meltable explosive containing a particulate component with only a very small proportion of the explosive material turning into riser scrap.

These and other objects of this invention are realized by providing an apparatus that maintains a quantity of explosive material, which may contain a particulate component, in a molten state, and simultaneously stirring the explosive material within a heated container to ensure its homogeneity while large numbers of munitions items are being filled therewith. Means for stirring the molten explosive material are deployed to ensure, in particular, that there is no clogging by a particulate component of delivery apertures in the container, molten material flow through the apertures being regulated by simultaneously operated valves. Each such valve communicates with a positive displacement piston-cylinder mechanism, which receives a controlled quantity of the stirred molten explosive material for forcible injection thereof through a temporary material guiding and distributing element having a riser into the interiors of a carefully positioned array of similar empty munitions items, the explosive material being displaced primarily horizontally into and out of the piston-cylinder mechanism. In one aspect of the invention, the actuation of the stirrer motor, the flow regulating valve and the positive displacement piston-cylinder mechanism are all effected pneumatically, thus avoiding the placement of electrical lines and equipment in the vicinity of the molten explosive. In another aspect of the invention, a plurality of similar positive displacement piston-cylinder mechanisms operate in tandem, each filling a plural array of empty munitions items, to provide a high volume production apparatus.

The preferred method for using this apparatus includes the steps of maintaining a meltable explosive in a molten state, stirring it while in said molten state to ensure its physical homogeneity, withdrawing a predetermined amount of the stirred homogeneous molten explosive and then forcibly injecting it, through primarily horizontal displacements of the same, simultaneously into the interiors of a plurality of munitions items.

Still other objects and advantages of the present invention will become readily apparent to those skilled in this art from the following detailed description, wherein only the preferred embodiments of the invention are shown and described, simply by way of illustration of the best modes contemplated of carrying out the invention. As will be realized, the invention is capable of other and different embodiments, and its several details are capable of modifications in various obvious respects, all without departing from the invention. Accordingly, the drawing and description are to be regarded as illustrative in nature, and not as restrictive.

BRIEF DESCRIPTION OF THE DRAWINGS

FIG. 2 is an enlargement of a portion of FIG. 1 to illustrate key structural details of the apparatus thereof.

FIGS. 4*a* and 4*b* are the plan and side elevation views, respectively, of a munitions holding/loading tray.

DESCRIPTION OF THE PREFERRED EMBODIMENTS

Many explosive materials suitable for use in anti-armor cluster munitions (ACMs), combined effects munitions (CEMs), and the like can be rendered molten at temperatures just below the boiling point of water, i.e., in the range of 200° F. to 210° F. Certain explosive compositions like Octol contain a particulate component HMX, so that when the mixture is heated it has the texture of a viscous slurry. To prevent precipitation of the particulate component of such an explosive mixture during the process of filling munitions items, it is necessary to continually stir the molten mixture.

Figure 1:
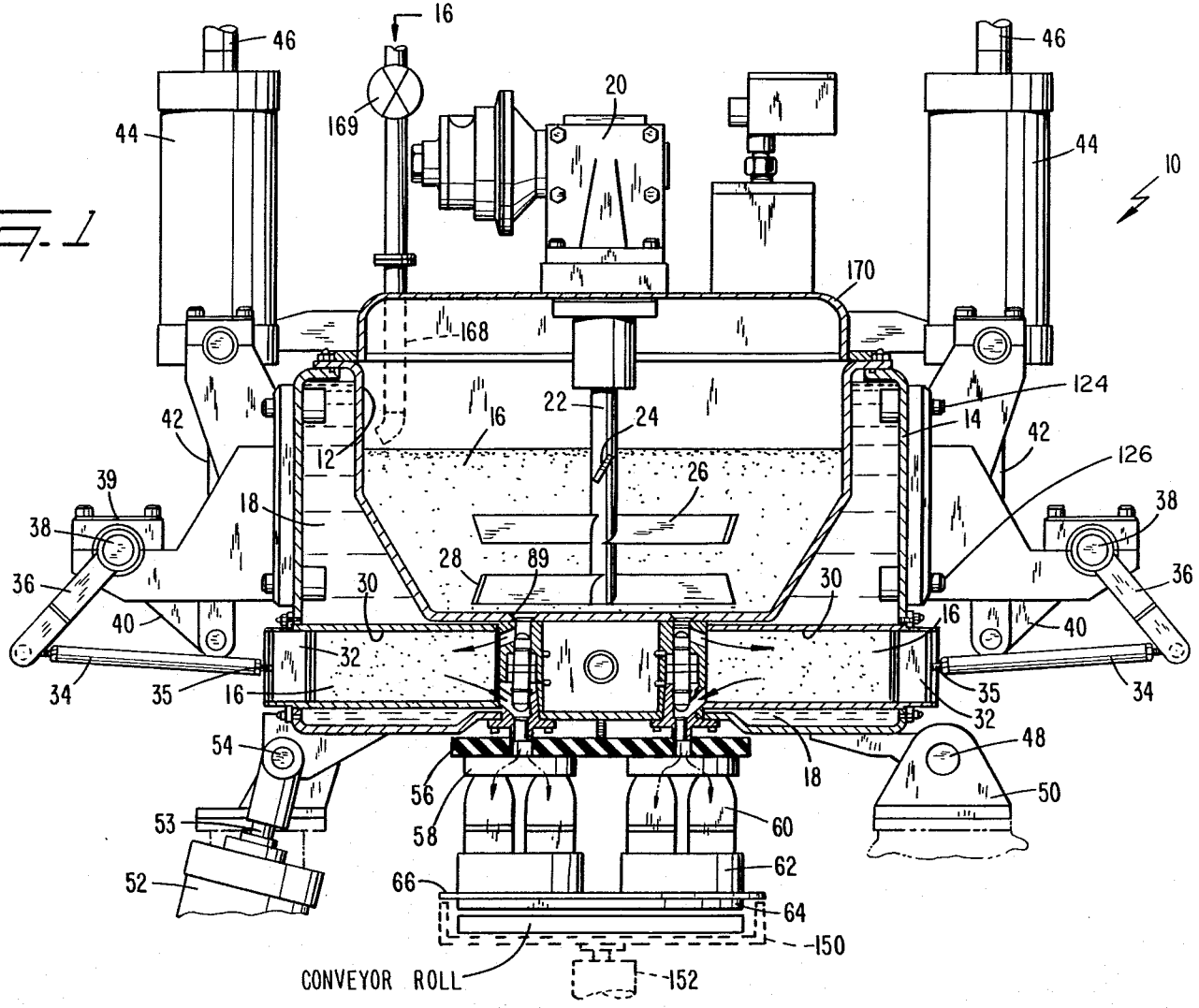
FIG. 1 is a partial transverse vertical cross-sectional view of a preferred embodiment of this invention.

The apparatus 10 of a preferred embodiment of the present invention is provided with a double-walled container having an outer generally rectangular wall 14, best seen in the vertical cross-sectional view of FIG. 1. An inner compartment is defined by wall 12 and is filled with the explosive material 16. The intervening space formed between the outer wall 14 and inner wall 12, as best seen with reference to FIG. 1, is filled with a continually replenished supply of hot water 18 entering through inlet 124 and leaving through outlet 126 in a controlled flow at a controlled inlet temperature. The explosive material 16 is therefore surrounded by and contained within a zone filled with hot water 18 maintained at a predetermined temperature high enough to keep explosive material 16 in a molten state.

One or more pneumatically actuated rotary air motors 20, provided with compressed air, are mounted on a cover supported by cylindrical walls 14 and 12 and each has a vertically downwardly depending shaft 22 provided with stirring paddles 24, 26 and 28. Stirring paddle 28 is located very close to the bottom of the explosive container 12 and, during operation, periodically sweeps past an array of tapered apertures such as 89 in the floor of the explosive containing space to positively counter any tendency for the particulate component from precipitating out of the stirred molten explosive mixture 16. The temperature and the rate of flow of hot water 18 in the water jacket surrounding the explosive material 16 are monitored and controlled by conventional means.

Figure 3A:
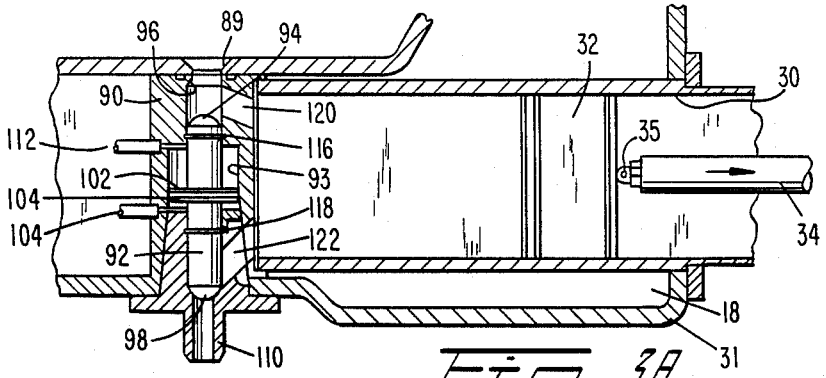
FIGS. 3*a* and 3*b* are vertical cross-sectional views of a positive displacemnt pump means of the apparatus of FIG. 1, showing respectively the lowermost and uppermost positions of a spool valve thereof.
Figure 3B:
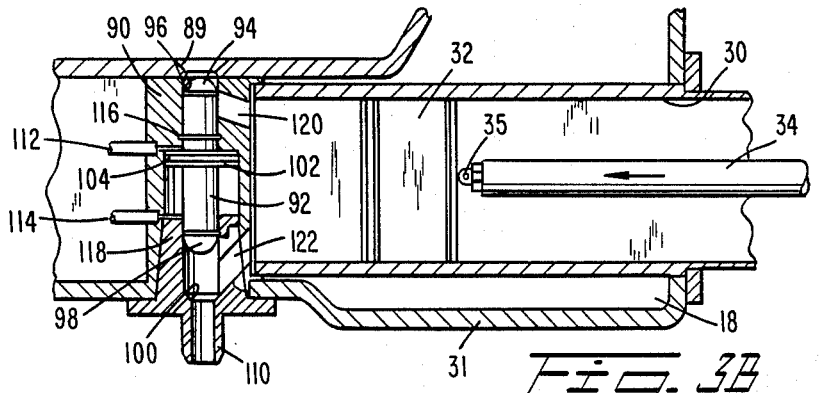

Referring now to FIGS. 2, 3*a* and 3*b*, a typical spool valve 92 is slidingly supported within a housing 90 mounted directly beneath each aperture 89 in the explosive container. The movable portion of spool valve 92 has a small diameter length with a short, central, larger diameter annular flange 102. Housing 90 is provided with O-ring seals 116 and 118 that act to slidingly seal around the smaller diameter portion of spool valve 92. Flange portion 102 of the spool valve is provided with a second sealing O-ring 104 that slidingly seals against a correspondingly large diameter annular space 93 within housing 90. Spool valve 92 is free to move in a vertical direction, and such motion is controlled and actuated by compressed air supplied through either supply port 112 or supply port 114 at the upper and lower ends, respectively, of the larger diameter annular space 93. Spool valve 92 has generally rounded ends, 94 at the top and 98 at the bottom Ends 94 and 98 may be made of molded silicone material for effective sealing action.

Housing 90 is provided with a chamfered aperture 96 at its upper end, communicating with opening 89 of the explosive container thereabove, and a similar chamfered aperture 100 at its lower end. Housing 90 also has a short, virtually horizontal passage 120 at its upper end immediately adjacent to aperture 96, and a similar somewhat inclined passage 122 immediately adjacent lower aperture 100.

Passasges 120 and 122 of valve housing 90 communicate with one end of a typical horizontal cylinder 30, surrounded by a hot water jacket 31 through which is flowed a portion of hot water 18 to maintain the explosive material 16 in a molten state. As best seen in FIGS. 3*a* and 3*b*, each cylinder 30 is fitted with a sliding piston 32 actuated by a connecting rod 34 pivotably attached thereto at a pivot 35.

Figure 5:
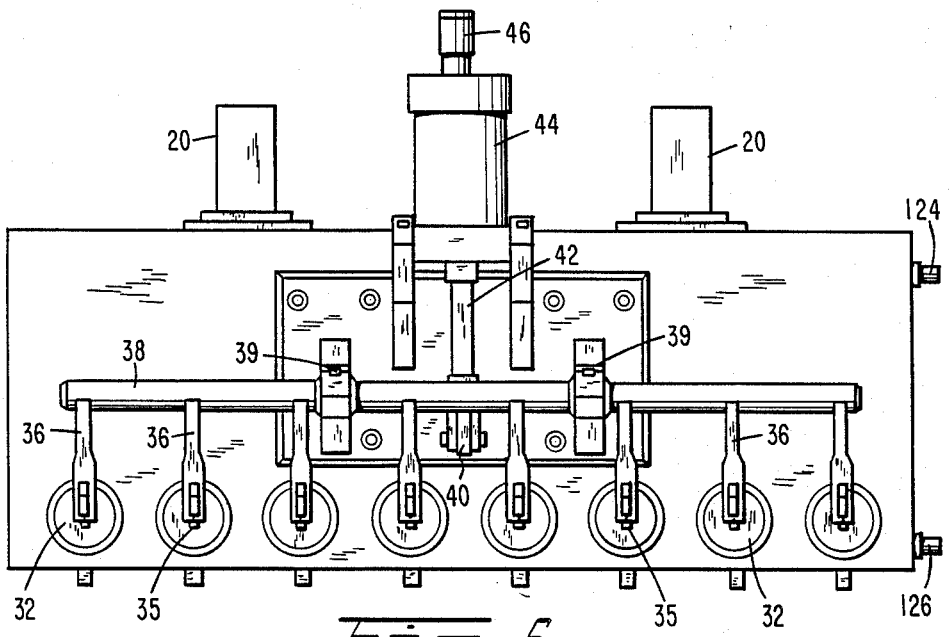
FIG. 5 is a side elevation view of eight-ganged positive displacement piston-cylinder mechanisms at one side of the apparatus of FIG. 1.

Referring now to FIGS. 1 and 5, pneumatic cylinders 44, preferably deployed one on each side of the water jacket surrounding molten explosive container 12, are provided with compressed air via pipes 46. Each cylinder 44 contains a vertically sliding piston (not shown) which acts in an up-and-down direction as the compressed air supply to the cylinder is controlled in a conventional manner. The amount of explosive that can be dispensed by means of cylinder 44 is controlled by a volume adjustment cap (not shown).

The vertical movement of the piston in each cylinder 44 drives a link 42 pivotably connected thereto at one end. The other end of link 42 is pivotably linked to an arm 40 of a generally L-shaped link having a second arm 36. Arms 36 and 40, as a pair, are rigidly connected to a shaft 38 rotatable in bearings 39. A connecting rod 34 is pivotably linked at one end to the distal end of arm 36 and at another end to piston 32 sliding inside positive displacement pump cylinder 30.

As best seen in FIG. 5, shaft 38 is selected to be long enough to provide for a number of L-shaped rotatable links formed of pairs of arms 36 and 40. Note that arms 40 are hidden behind shaft 38 in the view of FIG. 5.

Controlled supply of compressed air to the piston within cylinder 44 effects substantially vertical movement of the attached link 42, rotation of the attached arms 40 about shaft 38 and a corresponding rotation of arms 36 also attached to shaft 38. This results in the movement of the distal ends of arms 36 being communicated through connecting rods 34 to horizontally slidable pistons 32 to cause the same simultaneously to move horizontally within cylinders 30. Thus, in the embodiment depicted in FIG. 5, movement of the single piston in pneumatic cylinder 44 causes coordinated and simultaneous movement of eight pistons 32 arrayed therebelow.

As persons skilled in the art will immediately appreciate, conventional means such as electronically controlled relays and the like, may be employed to control the air supply to both pneumatic cylinders 44 and thus to all the assorted linkages and pistons attached thereto, to obtain symmetric and simultaneous motions of sixteen pistons 32 arrayed in sets of eight to each side (as best seen with reference to FIG. 1).

Compressed air cylinders to provide such reciprocal motion at a controlled rate are well known in industry and it is believed that persons skilled in the art are able to readily select approporiate valves, connections, and the necessary fittings to effectuate safe and efficient operation of the various elements combined in the apparatus of this invention as described herein.

As persons skilled in the art will appreciate, pneumatic actuation of piston 32 to the right in FIG. 3*a*, while spool valve 92 is actuated to be in its lowest position, will suck stirred molten explosive mixture through openings 89, 96 and 120 to fill the cylindrical space in front of piston 32. Such a controlled motion of piston 32 away from the valve housing, therefore, serves to charge cylinder 30 with a predetermined quantity of stirred molten explosive which enters cylinder 30 primarily in a horizontal direction.

As best seen with reference to FIG. 3*b*, actuation of spool valve 92 to move it to its uppermost position seals off the explosive container thereabove and opens passage 122 to allow the expulsion of the charge of stirred molten explosive from cylinder 30. By controlled actuation of pneumatic cylinder 44, connecting rod 34 is moved to the left, as best seen in FIG. 3*b*, so that the front face of piston 32 forcibly acts on the charge of stirred molten explosive contained within cylinder 30, moving the same primarily in a horizontal direction, to expel it forcibly through aperture 100 of valve housing 90, to direct the same downwardly through a short injection nozzle 110 having a generally tapered lower end.

It will be understood that in an actual working environment, with possible heat loss due to the environment, there may be a tendency for a charge of initially molten explosive to congeal within cylinders 30 and, therefore, hot water 18 is provided to hot water jackets 31 to maintain cylinders 30 and their contents at a suitable high temperature to maintain the explosive in its molten state.

Figure 8:
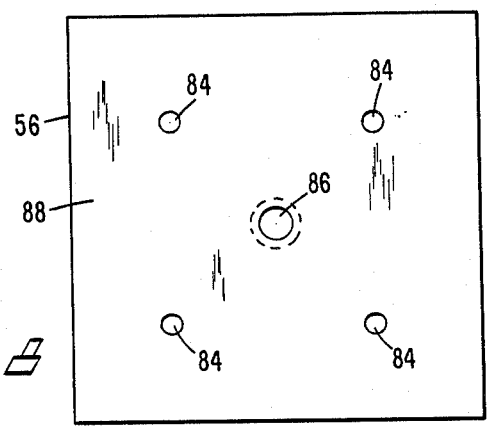
FIG. 8 is a plan view of a sealing plate to be used with a quartet of the explosive distributor elements illustrated in FIGS. 6*a* and 6*b*.

The principal elements of the apparatus described hitherto, which act together to maintain the explosive material 16 in a molten state, keep it stirred to ensure homogeneity of its composition, and remove controlled amounts thereof for forcible injection from the material delivery nozzle ports 84 (FIG. 8) of a plurality of positive displacement piston-cylinder means, are formed as unit supported on one side so as to be rotatable about a shaft 48 supported in a plurality of trunnions 50. At about the same level as shaft 48 and parallel thereto is a second shaft 54 to which is pivotably attached at least one rod 53 driven by a piston (not shown) in a large pneumatic cylinder 52. A compressed air supply (not shown) to pneumatic cylinder 52 may thus be used to raise rod 53 linked to shaft 54 to cause the entire apparatus to rotate about shaft 48 supported in trunnions 50. As will be appreciated, in the position depicted in FIG. 1, the axes of all of cylinders 30 are horizontal. This particular configuration will be referred to as "the operating" mode of the injection apparatus in subsequent discussion. When the apparatus is rotated about shaft 48 by actuation of pneumatic cylinder 52, so that the axes of cylinders 30 are inclined at an angle to the horizontal, the apparatus will be referred to as being in the "non-operating" mode.

As best seen with reference to FIG. 1, when the apparatus is in its operating mode, the tapered ends of nozzles 110 are closely inserted into matchingly located apertures 84 of a sealing element 56 communicating through guidance and distribution elements 58 with a plurality of muntions items 60 held in a predetermined distribution by a muntions support tray 64. As best seen in FIGS. 4*a* and 4*b*, the flat upper surface 66 of munitions support tray 64 is provided with upward extensions 62 (in the form of short arcs in plan view) and 68 (in the shape of "+" signs in plan view). As persons skilled in the art will appreciate, such trays 64 can be sized and shaped to suit different types of munitions items 60. Thus, per FIG. 4*a*, when the munitions items 60 are small there may be gaps between the four sets of munitions items 60 supported on surface 66. On the other hand, when the munitions items 60 have rather large diameters, correspondingly shaped munitions support trays 64 will be required such that there are relatively small gaps between the sets of four munitions items 60 disposed thereon. The important feature that must be common in the dimensioning of such munitions support tray 64 is that the centers of each set of four munitions items, also the meeting point of all four arms of each upward extension 68, must be located to be aligned with injection nozzles 110 inserted through apertures 84 of sealing element 56 thereabove.

Figure 6A:
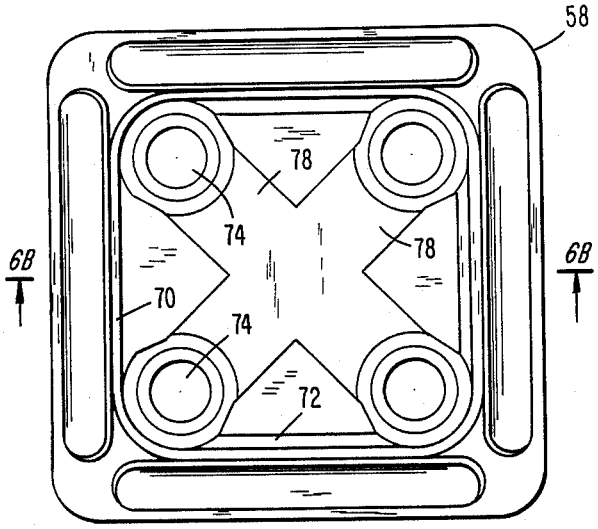
FIGS. 6*a* and 6*b* are a plan and transverse vertical cross-sectional views respectively, of a molten explosive distributrion element of the preferred embodiment.
Figure 7A:
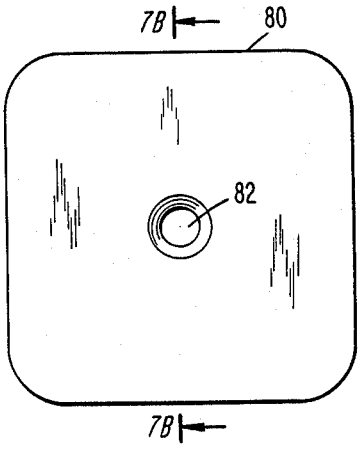
FIGS. 7*a* and 7*b* are the plan and vertical transverse cross-sectional views, respectively, of a cover plate for use with the explosive distributor element of FIG. 6*a*.
Figure 6B:
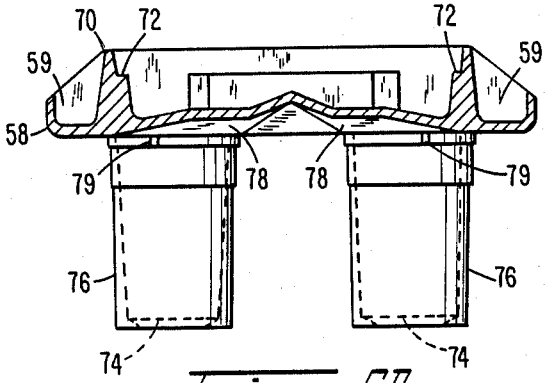
Figure 7B:
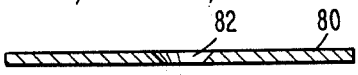

Referring now to FIGS. 6*a* and 6*b*, it will be seen that the typical guidance and disribution element 58 is formed to be of a generally square shape and having an upper peripheral edge 70 and a parallel inside recessed surface 72 shaped to closely receive a flat plate 80 thereon. As best seen with reference to FIGS. 7*a* and 7*b*, flat plate 80 has a central aperture 82 provided with a chamfered edge. When plate 80 is placed to rest on surface 72 it defines a space therebelow. This space has a lower configuration that includes four gently slooping guidance channels 78 each of which leads to the inside of a generally cylindrical and slightly tapered downward extension 76. Each extension 76 is further provided with a tapered large opening 74 at its lowest end. Thus, when plate 80 is placed to rest on surface 72 of guidance and distribution element 58, it is possible to inject molten explosive material downward through aperture 82 to flow substantially horizonally along channels 78 and then downward through aperture 74 of exensions 76 into individual empty munitions items 60. As indicated in FIG. 2, extensions 76 actually are inserted into the insides of empty munitions elements 60. While this one embodiment indicates plate 80 can be used on fixture 58 (FIG. *6a*) for sealing, the preferred sealing means is to use plate 56 on 58, since plate 56 is attached under the injector, and injector nozzle 110 protrudes through 84 for passing explosive to 58 and to 60. Mating problems with aperture 82 and nozzle 110 are thus avoided.

In operating mode of the apparatus, as illustrated in FIGS. 1 and 2 hereof, operation of piston 32 in a typical cylinder 30 may therefore be employed to forcibley inject stirred molten explosive mixture through nozzle 110, for guidance and distribution by element 58 simultaneously through extensions 76, into a set of four similar empty munitions items 60 supported therebelow. It will also be seen that each positive piston-cylinder displcement means compromising cylinder 30 and piston 32 thus feeds explosive material to a set of four empty munitions items 60. Thus four pistons, two on each side, must act to fill the sixteen empty munitions elements supported on each tray 64 therebelow. Simultaneous actuation of the pistons, as described hereinabove, is thus employed to simultaneously provide controlled amounts of the explosive material to a large number of munitions items 60.

As indicated earlier, all of pistons 32 may be actuated simultaneously. In the preferred embodiment illustrated in the figures of this application, there are sixteen such cylinders each feeding four empty munitions elements. In other words, each operation of the apparatus, actuating all sixteen cylinders, serves to fill sixty-four empty munitions elements. When this injection is completed, pneumatic cylinder 152 is actuated to lower a yoke 150 holding tray 64 (with munitions 60) under the injector to a position where tray 64 rests on a conveyor. The trays 64, with the sixteen filled munitions elements and,- the four distribution elements 58 thereon, are then removed and placed aside in a water bath (not shown) for the explosive to solidify upon cooling.

As each munitions item 60 receives molten explosive through aperture 74 of extension or user 76 inserted therein, the air initially contained therein is displaced outward and flows through small apertures 79 (best seen in FIG. 6B) provided at the very top of each extension 76. In other words, during operation of the apparatus, molten explosive flows into each extension 76 to fill the munitions therebelow and the displaced air flows out the munitions items through aperture 79 in distribution element 58.

It should be understood that the volume swept by each piston 32 in the positive displacement means is determined by the length of the stroke thereof, a parameter controlled by the amount of motion provided to the piston by pneumatic cylinder 44 through linkages 42, 40, 36 and connecting rod 34. Thus control of compressed air to pneumatic cylinder 44 is the means by which the amount of explosive material flowing per stroke of each piston 32 is determined. The amount of explosive material thus controllably injected through nozzle 110 into each distribution element 58 is selected to be slightly larger than the volume needed to exactly fill the four empty munitions elements 60 positioned therebelow. This excess material resides inside each extension 76 and in distribution element 58 recess when the delivery stroke of piston 32 is completed.

As the molten explosive cools within the filled elements 60, it contracts somewhat and further draws in some of the molten material contained inside extensions 76. Any residual air in each element 60 is displaced through the corresponding aperture 79. Thus each guidance and distribution element 58 also provides individual risers to each filled munitions element 60. When solidification of explosive is completed, tray 64 with elements 60 and 58 are removed from the cooling bath and distribution element 58 is carefully lifted off the filled cooled munitions element 60 therebelow. The small amount of congealed cooled explosive material still contained within each extension 76 may be removed by turning element 58 upside down and tapping it gently. It will be appreciated that the removal of each extension 76 from the corresponding filled munitions element 60 will leave a correspondingly shaped void at the top thereof. This may be appreciated best by reference to FIG. 2 indicating in broken lines the dispositon of extensions 76 within munitions elements 60. This vacant space may be filled by the fuse mechanisms for the individual munitions items.

It will be appreciated that the presence of electrical wiring, electrical motors with the possibility of occasional sparks, or any objects that attain significantly high temperatures during their operation or use, are all highly undesirable in an environment that contains quantities of an explosive material. It is therefore highly preferable, safe and convenient to operate stirrer motor 20 to stir the explosive material, spool valves 92 to control the flow of explosive material, pistons 32 to positively displace explosive material, and pneumatic cylinders such as 44 and 52 to actuate the pistons and to lift the apparatus, respectively, all by means of compressed air delivered in controlled amounts and at predetermined pressures to effect the necessary motions. The knowledge of how to select these parameters should be well within that possessed by persons skilled in the art.

The basic manner of operating the apparatus is as follows. A quantity of molten material 16 is deposited within the explosive containment chamber defined by wall 12, through a hot water jacketed delivery pipe 168 controlled by a supply control valve 169 (see FIG. 1) typically in amounts sufficient to fill the injector reservoir/batches of empty munitions items 60. Hot water 18 is provided at a controlled rate and temperature to generate and maintain a hot environment around the explosive material 16 to maintain the latter in a molten state throughout the operational process. Stirrer motor 20 is actuated and operated at a controlled speed to stir the molten explosive material and to maintain it in a stirred condition to ensure that there is no precipitation of any particulate components of the explosive mixure 16 therefrom. It will be understood that during this process all of spool valves 92 are at their uppermost positions to prevent any egress of the molten explosive material through apertures 89.

A controlled flow of hot water 18, preferably at a temperature comparable to that of the hot water surrounding the bulk of the explosive material, is provided and maintained through the hot water jackets 31 surrounding cylinders 30. Thus, in the preparatory stages, not only is the explosive material 16 maintained molten and stirred to obtain homogeneity of the mixture, but cylindess 30 and pistons 32 are simultaneously heated to receive and handle the explosive material in its molten state. At this stage, spool valves 92 are at their uppermost positions and pistons 32 are located close to respective valve bodies 90 connected thereto.

For the embodiment illustrated in the figures hereof, provided with sixteen pistons 32, four munitions support trays 64, each supporting sixteen empty munitions items 60, are prepared with sixteen guidance and distribution elements 58 placed as indicated in the figures. Pneumatic cylinder 152 is actuated to raise the yoke 150 holding the tray 64 so that distribution element 58 and munitions items 60 are placed in proper correspondence with the injector seal plate 56.

Note that sealing plate 56 has a thin metal backing plate 88, with matching apertures therein to receive nozzles 110. The material of sealing plate 56 is firm but elastic to facilitate sealing under pressure, can withstand the temperatures encountered during use, and is chemically and physically inert to explosive material contacting the same. A threaded stud 128 and a nut 130 threaded thereon are employed to hold sealing plate 56 in proper sealing communication with nozzles 110. The inherent flexibility of the principal material comprising sealing plate 56 causes close fitting thereof around each nozzle 110 inserted therein. With this arrangement, when the tray loading apparatus with munitions is lifted by actuation of pneumatic cylinder 152, element 58 butts against sealing plate 56. The lower surface of sealing plate 56 is pressed onto each of the guidance and distribution elements 58 supported therebelow on top of and in communication with empty munitions items 60. In other words, when the tray loading fixture apparatus is lifted to its operating mode there is a sealed connection between nozzles 110 and the empty munitions items 60.

Conventional control means may be used to effect the necessary coordination and timing of the motions of the various elements. When the sixty four empty munitions items 60 are filled, as indicated earlier, the tray loading fixture apparatus is lowered onto a conveyor (not shown) and munitions 60 on tray 64 are removed to a location for cooling.

Experimental studies show that when stirred molten explosive mixtures are moved primarily in a horizontal direction by pressurizing explosive and with fluid flow paths reduced by this design, in the process of filling a munitions item, there are no problems with the precipitation of particulate components from the bulk of the molten explosive material. The apparatus and method of this invention utilize this knowledge and deliberately ensure that the primary motion of the molten explosive from supply to the munitions item is pressurized in the horizontal direction, explosive components do not settle out and explosive flow paths are reduced to decrease friction flow. The requisite pneumatically actuated mechanisms are commercially available to move promptly and safely and in synchronization with each other with utilization of well known controls. These are, therefore, highly suitable and safe to provide the necessary motions to practice this invention. The pneumatically actuated forced injection of the liquid molten explosive material into individual munitions items 60 ensures the filling thereof to a higher density and more consistently than is possible with the old fashioned hand- pour techniques.

It will be appreciated that both the apparatus and the method are very versatile and provide the facility to fill munitions items of a variety of shapes, sizes and capacities by suitable selection of support trays 64 and then locations below sealing element 56. Small-volume munitions items will be filled with short strokes by piston 32 and short items will require commensurately higher location of support trays 64. The apparatus and method as disclosed herein therefore are suitable for high volume munitions production facilities. If there is a surplus of a particular explosive material left after the filling of a batch of munitions items, normal actuation of valves 92 and pistons 32 can be employed to completely discharge the explosive container 12, with the surplus explosive material delivered through nozzles 110 for removal and storage thereof.

A principal advantage of the apparatus and method according to the preferred embodiment of this invention is that the amount of surplus explosive material left after the filling of each munitions item is extremely small and is contained primarily within a distribution element 58 that is convenient to handle and clean, thus reducing risks while facilitating rapid munitions filling activity.

Another advantage of this invention is that the injector cover part 170 (with assembled fixtures and instrumentation) can be detached from the main body 12/14, for cleaning and maintenance. For cleaning and maintenance the injector can also be elevated by lifting 53 with cylinder 52 and rotating 10 around shaft 48 in trunnion 50.

In this disclosure, there are shown and described only the preferred embodiments of the invention, but, as aforementioned, it is to be understood that the invention is capable of use in various other combinations and environments and is capable of changes or modifications within the scope of the inventive concept as expressed herein.

What is claimed is:

1. Apparatus for positively and simultaneously injecting an explosive material into a plurality of munitions items, comprising:

means for maintaining a quantity of explosive material in a molten state;

means for stirring said molten explosive;

a plurality of valve means, each of said valve means operatively communicating with said maintaining means, operable for controlling simultaneous transfer of a predetermined amount from said stirred molten explosive material through each valve means, each of said valve means having a first and second operating position;

a plurality of positive displacement means, each respectively connected to one of said plurality of valve means for receiving said predetermined amount of stirred molten explosive material transferred therethrough while said corresponding valve means is in said first operating position and, thereafter, positively displacing said predetermined amount of molten explosive material through said corresponding valve means in said second operating position thereof, for positive simultaneous injection of said predetermined amount of stirred molten explosive material from each of said positive displacement means into each of said plurality of munitions items;

distribution means, temporarily located intermediate each of said plurality of positive displacement means and each of said plurality of munitions items, for distributing said molten explosive material into each of said munitions items and said distribution means having a small-volume temporary riser to hold some of said injected molten explosive material to accommdate for shrinkage of said injected molten material cooling within said munitions items; and means for controlling simultaneous operation of said plurality of valve means and said corresponding plurality of positive displacement means.

2. Apparatus according to claim 1, wherein:

said stirring means, said plurality of valve means and said plurality of positive displacement means are all pneumatically actuated.

3. Apparatus according to claim 1, wherein:

said plurality of positive displacement means is disposed such that any physical motion of said predetermined amount of stirred molten explosive material into and out of each of said plurality of positive displacement means is primarily in a horizontal direction.

4. Apparatus according to claim 1, wherein:

an explosive material useable with said apparatus comprises a mixture of a meltable component and a particulate component; and said maintaining means and said stirring means coact to ensure that said particualte component is thoroughly mixed with said meltable component and does not precipitate during use of said apparatus.

5. Apparatus according to claim 4, wherein:

said plurality of valve means is located below said maintaining means; and said stirring means comprises a rotatable stirring element that rotates within said quantity of molten explosive material adjacent the lowest reaches thereof, thereby to counteract any tendency of said particualte component to precipitate and block any of said plurality of valve means thereunder.

6. Apparatus according to claim 1, wherein:

said maintaining means comprises of hot-water jacket surrounding said quantity of explosive material to maintain the same in a molten state.

7. Apparatus according to claim 1, wherein:

each of said plurality of valve means comprises a pneumatically actuate spool valve.

8. Apparatus according to claim 1, wherein:

each of said plurality of positive displacement means comprises a piston reciprocating inside a cylinder.

9. A method for simultaneously and positively injecting an explosive material into a plurality of munition item elements, comprising the steps of:

maintaining a quantity of said explosive material in a molten state;

simultaneously withdrawing a predetermined plurality of separate amount of said explosive material; and positively and simultaneously injecting each of said plurality of predetermined amounts of said molten explosive material into each of said plurality of munitions item elements and into a small-volume temporary riser to accomodate for shrinkage of said injected molten explosive cooling within each of said munitions items after said injection.

10. A method according to claim 9, further comprising the step of:

stirring said explosive material maintained in said molten state.

11. A method according to claim 10, wherein:

said withdrawing step and said injecting step comprise moving of said amount of stirred molten material primarily in a horizontal direction.

12. A method according to claim 11, wherein:

the steps of stirring, withdrawing and positively injecting said stirred molten explosive material are obtained pneumatically.

* * * * *